United States Patent [19]

Velencei

[11] Patent Number: 4,834,034

[45] **Date of Patent: * May 30, 1989**

[54] INTERNAL COMBUSTION ENGINES

[76] Inventor: John Velencei, Daly Rd., Far Hills, N.J. 07931

[ * ] Notice: The portion of the term of this patent subsequent to Jul. 28, 2004 has been disclaimed.

[21] Appl. No.: 78,225

[22] Filed: Jul. 27, 1987

Related U.S. Application Data

[63] Continuation-in-part of Ser. No. 674,945, Nov. 26, 1984, Pat. No. 4,682,570.

[51] Int. Cl.[4] ..... F02B 33/04

[52] U.S. Cl. ..... 123/73 PP; 123/73 A; 123/65 R

[58] Field of Search ..... 123/65 R, 65 UC, 65 U, 123/73 R, 73 A, 73 PP

[56] References Cited

U.S. PATENT DOCUMENTS

| | | | |
|---|---|---|---|
| 1,292,322 | 1/1919 | Hunt | 123/73 PP |
| 1,540,286 | 6/1925 | Roberts | 123/73 A |
| 2,316,790 | 4/1943 | Hickey | 123/650 C |
| 2,337,245 | 12/1943 | Jacklin | 123/650 C |
| 2,367,565 | 1/1945 | Curtis | 123/650 C |
| 2,389,510 | 1/1944 | Olsson | 123/65 UC |
| 2,442,082 | 5/1948 | French | 123/650 C |
| 2,447,041 | 8/1948 | Sues | 123/650 C |
| 2,516,708 | 7/1950 | Lugt | 123/73 PP |
| 2,572,768 | 10/1951 | Scheeberger | 123/73 PP |
| 3,971,297 | 7/1976 | Fox | 123/73 PP |
| 4,004,557 | 1/1971 | Acker | 123/73 PP |
| 4,066,050 | 1/1978 | Ford-Dunn | 123/73 A |
| 4,359,017 | 11/1972 | May | 123/73 R |
| 4,388,895 | 6/1983 | Boyesen | 123/73 PP |
| 4,395,978 | 8/1983 | Boyesen | 123/73 PP |
| 4,682,570 | 7/1987 | Velencei | 123/73 PP |

FOREIGN PATENT DOCUMENTS

| | | | |
|---|---|---|---|
| 0159918 | 10/1982 | Japan | 123/73 A |
| 362453 | 12/1931 | United Kingdom | 123/65 W |

*Primary Examiner*—Carl Stuart Miller

*Attorney, Agent, or Firm*—Jack B. Murray, Jr.

[57] ABSTRACT

The present invention relates to an internal combustion engine cylinder assembly comprising a cylinder having substantially vertically disposed interior walls defining a firing chamber therein; piston means housed within the firing chamber and adapted for vertical reciprocation within the firing chamber; gas inlet channels in the lower portion of the firing chamber; a crankcase housing having a gas compression chamber disposed therein; valve means adapted for passing air into the gas compression chamber upon the depressuring thereof; cylinder closure means positioned at the upper end of the cylinder defining the upper end of the firing chamber and being provided with exhaust gas valve means, adapted for cyclic opening and closing to alternatively permit the removal of exhaust gases from the firing chamber and the pressuring of fresh fuel/air mixtures in the firing chamber; fuel introduction means for introducing fuel into the upper portion of the firing chamber; fuel ignition means for igniting a compressed fuel/air mixture in the firing chamber; at least a portion of the cylinder inner walls extending downwardly into the gas compression chamber and adapted to house at least a portion of the piston means therein during the full downstroke of the piston means; the upper portion of the crankcase housing having inwardly converging walls to define a converging gas space in the upper portion of the gas compression chamber annularly about the downwardly extending cylinder portion.

20 Claims, 3 Drawing Sheets

INTERNAL COMBUSTION ENGINES

CROSS REFERENCE TO RELATED APPLICATIONS

This application is a continuation-in-part of my copending application Ser. No. 674,945, filed Nov. 26, 1984 now U.S. Pat. No. 4,682,570 and is also related to my copending application Ser. No. 674,944, filed Nov. 26, 1984, now U.S. Pat. No. 4,683,845, the disclosures of which are hereby incorporated by reference in their entirety. This application is also related to my co-pending application Ser. No. 78,226, filed Jul. 27, 1987.

FIELD OF THE INVENTION

This invention relates generally to the field of internal combustion engines, and more particularly to two-stroke internal combustion engines.

DESCRIPTION OF THE PRIOR ART

U.S. Pat. No. 1,292,322 is directed to a water cooled two cycle gas engine provided with a dual walled cylinder having a lower, rotatably mounted perforated valve member for gas entry and actuated by a first cam and spring/rocker arm arrangement. Gases exhaust through an upper reciprocating sleeve valve member controlled by a cam movably connected to the shaft to which the cylinder's piston connecting rod is also connected.

U.S. Pat. No. 1,540,286 relates to an internal combustion piston engine provided with exhaust valves located in the upper portion of the cylinder. The engine is also provided with either a rotary gas inlet or a crankcase gas inlet valve communicating with a crankcase gas pressuring chamber.

U.S. Pat. No. 2,337,245 discloses an internal combustion engine of the two stroke type having a set of gas inlet ports at one end of the cylinder and a set of gas exhaust ports at the other cylinder end. Each set of gas ports is opened and closed by means of a separate reciprocating piston which is positioned in the cylinder.

U.S. Pat. No. 2,516,708 relates to a single-acting two-stroke cyclic internal combustion engine having an associated air scavenging chamber adjacent to the gas inlet end of the cylinder.

U.S. Pat. No. 2,572,768 also relates to a two-stroke internal combustion engine having gas inlet ports providing swirling motion by tangential gas injection arrangements.

U.S. Pat. No. 2,361,790 relates to an internal combustion engine having a variable compression ratio which is provided by an auxiliary piston which reciprocates in synchronism with the working piston and functions to open and close valve ports of the engine and by a mechanism for ranging the stroke of the auxiliary piston.

U.S. Pat. No. 3,971,297 relates to a two cycle engine with three peripheral, oppositely displaced by-passes about the piston, to increase the breathing of the engine by by-passing virtually the entire perimeter of the piston.

U.S. Pat. No. 4,004,557 discloses a piston cylinder assembly having a cup-like upper extension of the piston, and a plurality of vertical passages between the crankcase and the cylinder.

U.S. Pat. No. 4,066,050 relates to two stroke internal combustion engines having a plurality of transfer ports controlled by the movement of the piston wherein some, but not all, of the transfer ports are provided with pressure-responsive non-return valves which are slightly biased toward the closed position, to restrict gas flow through those passages under predetermined engine conditions.

U.S. Pat. No. 4,359,017 relates to an internal combustion engine having diametrically opposed, co-axial cylinders, in each of which a piston in housed.

Japanese Patent Publication No. 57-159,918 relates to two cylinder engines wherein the connecting rod is cooled and lubricated by means of openings in the non-thrusting section of a piston and by providing an auxiliary scavenging passage which connects the openings to a scavenging passage in the process of scavenging.

British Pat. No. 362,453 relates to a two stroke compression ignition internal combustion engine.

BRIEF DESCRIPTION OF THE DRAWINGS

In the Figures, the same number refers to the same or similar elements.

SUMMARY OF THE INVENTION

Figure 1:
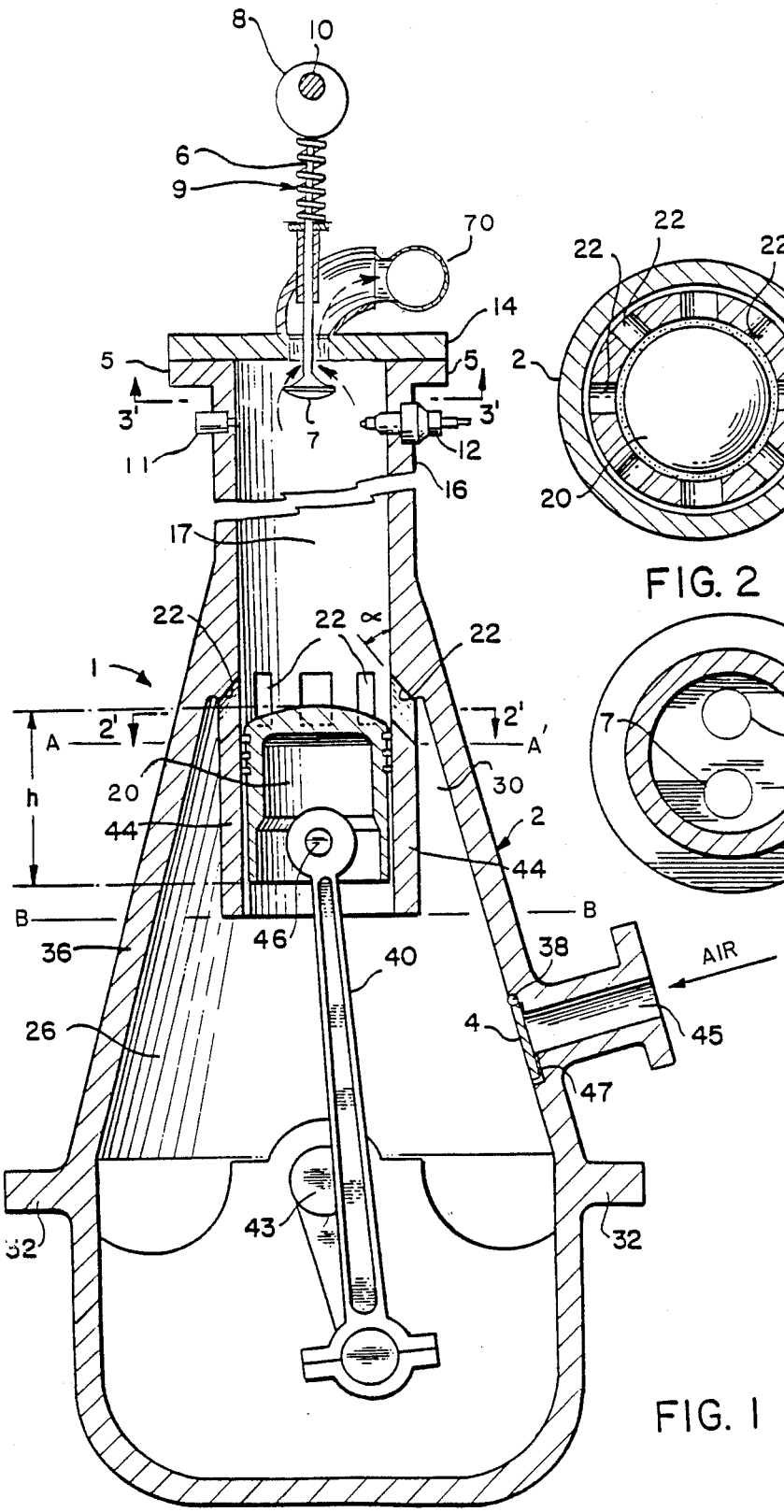
FIG. 1 is a vertical cross-sectional view of one embodiment of a fuel-injected, spark ignited internal combustion engine of this invention, with a single cylinder thereof being illustrated.

An internal combustion engine cylinder assembly comprising a cylinder having substantially vertically disposed interior walls defining a firing chamber therein; piston means housed within the firing chamber and adapted for vertical reciprocation within the firing chamber; gas inlet channels in the lower portion of the firing chamber; a crankcase housing having a gas compression chamber disposed therein; valve means adapted for passing air into the gas compression chamber upon the depressuring thereof; cylinder closure means positioned at the upper end of the cylinder defining the upper end of the firing chamber and being provided with exhaust gas valve means, adapted for cyclic opening and closing to alternatively permit the removal of exhaust gases from the firing chamber and the pressuring of fresh fuel/air mixtures in the firing chamber; fuel introduction means for introducing fuel into the upper portion of the firing chamber; fuel ignition means for igniting a compressed fuel/air mixture in the firing chamber; at least a portion of the cylinder inner walls extending downwardly into the gas compression chamber and adapted to house at least a portion of the piston means therein during the full downstroke of the piston means; the upper portion of the crankcase housing having inwardly converging walls to define a converging gas space in the upper portion of the gas compression chamber annularly about the downwardly extending cylinder portion, the gas inlet channels providing gaseous communication between the firing chamber and the converging gas space, and the piston means being arranged to cyclically open and close the gas inlet channels to control the gaseous communication; the piston means cooperating with the exhaust valve means, the fuel introduction means, and the fuel ignition means for controlling the pressurization and charging of fresh air into the firing chamber from the converging gas space, for introduction of fuel to the firing chamber, and the compression and ignition of the resulting fuel/air mixtures in the firing chamber to generate power and to remove from the firing chamber the thus-generated exhaust gases.

DETAILED DESCRIPTION OF THE INVENTION

Referring to FIGS. 1–3 and 4–6, a single cylinder of two embodiments of engines of this invention are illustrated. It will be understood that engines of this invention can comprise a single such engine cylinder, or a multiple of such cylinders, all the cylinders of said engine being the same in principle and mechanism, the particular engine shown being of especially light construction and designed for use in motorcycles, boats, electrical generators, chain saws, weed cutters and the like.

As illustrated, the engine is air cooled, as is preferred, although it will be understood that water or oil cooling can be provided, if desired, by provision of a suitable jacket about at least a portion of cylinder 16 to contain the selected cooling fluid and to maintain such fluid in a wall cooling relationship in contact with the outer walls of cylinder 16. It will be understood that the outer walls 16 can be provided with suitable conventional cooling fins to assist in the convection cooling of the cylinder walls, and hence the engine itself.

As illustrated, my engine, indicated generally at 1, comprises a crankcase housing 2 which is provided with a suitable engine mounting means 32 and which is associated with a crankshaft 43 and a connecting piston rod 40, which is in turn rotatably connected to a piston 20 by means of wrist pin 46.

A gas compression chamber 26 is provided within the upper portion 36 of crankcase housing 2 which is in cyclic gas communication with gas inlet 45. Gas compression chamber 26 can comprise an elongated chamber as illustrated in the Figure, although other geometries (e.g., a substantially circular chamber 26) can also be employed.

Inlet 45 is opened and closed by means of valve means which can comprise a reed valve 4 positioned in a recessed portion 47 of the inner walls of crankcase housing 2. In the embodiment which is illustrated, reed valve 4 is pivoted at 38 for pivotal motion inwardly into compression chamber 26 to permit gas flow thereinto when the gas pressure in chamber 26 is less than the gas pressure in passage 45. Reed valve 4 is prevented from pivoting into passage 45 upon pressuring of gas chamber 26 by suitably sizing recessed portion 47 to securely seat valve 4 therein when valve 4 is in the closed position (as shown in FIG. 1) and the fit of valve 4 within recessed portion 47 should be such as to substantially prevent the backflow of gases from gas chamber 26 into passage 45 when chamber 26 is pressured, as will be described in more detail below. Reed valve 4 can also be positioned in passage 45 for controlling the flow of air into gas chamber 26. One or more such reed valves 4 can be provided, and can be located in the walls or other surfaces (e.g., the bottom surfaces) of housing 2. Preferably, reed valve 4 is located below the lower lowermost level reached by piston 20 in operation of the engine. Valve means 4 can also comprise a rotary valve, or a piston-type valve positioned, e.g. in passage 45, for controlling the flow of air into chamber 26.

Cylinder 16 comprises a hollow, substantially cylindrically member adapted to house therein a firing chamber 17 and piston 20 within chamber 17 so as to permit piston 20 to vertically reciprocate in firing chamber 17. Preferably, cylindrical member 16 and firing chamber 17 are each substantially elongated, although it will be understood that such geometries are not essential, and e.g., member 16 can be constructed to define a substantially square firing chamber 17 wherein the bore, or internal diameter of the chamber, is substantially equal to the stroke of piston 20.

At least a portion of the cylinder, indicated at 44, projects downwardly into gas chamber 26, to house at least a portion of piston 20 at its lowest (downstroke) point. Preferably, the length of wall portion 44 thus positioned will range from about 0.1 to 2 times the height "h" of piston 20, and more preferably from about 0.4 to 1.5 times such height "h". However, such dimensions are only preferred and other lengths of wall portion 44 can also be used.

Cylinder 16 is securely affixed to crankcase housing 2 and, as is illustrated in FIG. 1, cylinder 16 and crankcase housing 2 can be formed as a unitary structure.

Figure 2:
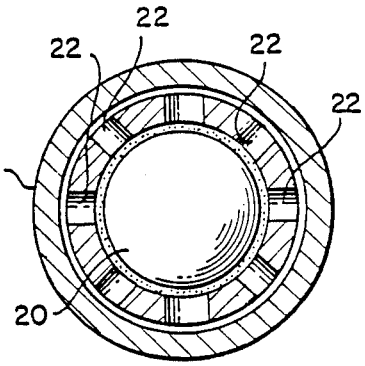
FIG. 2 is an enlarged horizontal cross-sectional view of the cylinder of FIG. 1 taken along line 2'—2' in FIG. 1.
Figure 3:
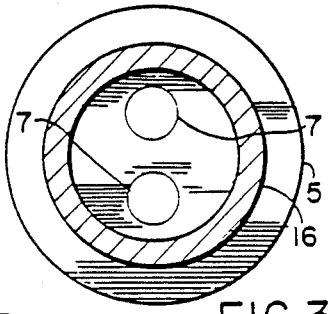
FIG. 3 is an enlarged horizontal cross-sectional view of the cylinder of FIG. 1 taken along line 3'—3' in FIG. 1.

A plurality of spaced apart gas channels 22 are provided in the walls of cylinder 16 adjacent to lower portion 44 to permit gaseous communication between firing chamber 17 and gas compression chamber 26. The manner in which such gas channels are opened and closed will be described below. The number and precise positioning of channels 22 can vary, but preferably channels 22 are spaced substantially evenly about the circumference of the cylinder wall portion 44 as shown in FIG. 2, and provide direct gaseous communication therebetween. The number and size of such channels 22 is preferably selected as that which provides the maximum air flow, hence the greatest cross sectional area, consistent with the need to maintain the structural integrity of walls 16 and 44. Generally from about 2 to 20 such channels 22 will be employed, with from about 6 to 10 being preferred. Where a plurality of such channels are used, each such channel 22 will preferably have a horizontal cross-sectional area (as shown in FIG. 2) which is from about 1 to 10 percent, and more preferably from about 3 to 8 percent, of the total cross-sectional area of the annulus (defined in such a view, inclusive of all channels 22) of cylinder wall 16. Also, the total area of such channels 22 will generally range from about 10 to 60 percent or more, and preferably from about 25 to 45 percent, of the total cross sectional area of such cylinder wall annulus.

At the upper end of cylinder 16 is provided cylinder head plate 14 which defines the upper end of firing chamber 17. Head plate 14 can be removably secured to a circular connector plate 5, forming the upper lip of wall 16, e.g. by means of bolts (not shown). Gas exhaust 70 means are provided in head plate 14 and preferably comprise exhaust valves 7 having a tapered lower end and an elongated shaft 6 projecting upwardly through plate 14. The manner in which exhaust valves 7 are caused to open and close can vary, and preferably each valve 7 is provided with a spring 9 about shaft 6 above plate 14 and an associated cam member 8 which is in turn rotatably secured to cam shaft 10, which when rotated causes shaft 6, and hence valve head 7, to move cyclically in a vertical relationship to plate 14. Exhaust gases are permitted to escape from firing chamber 17 through cylinder head plate 14 along each shaft 6 when the associated valve 7 is in the open position (as shown in FIG. 1). If desired such gases can then be collected into a conventional exhaust manifold (e.g. via 70) which can be positioned above cylinder head plate 14.

The number and precise positioning of valve means 7 can vary, although from 1 to 4 such valves 7 will be generally sufficient for each such apparatus (that is, for each cylinder 16), and such valves will be generally spaced substantially evenly about the circumference of the upper end of firing chamber 17 to permit the rapid removal of the exhaust gases from chamber 17 and to avoid substantial backmixing and turbulence of the exhaust gases, and hence the resulting inefficiencies in operation which have plagued prior art devices.

At least one conventional spark plug (e.g., 1 to 6 spark plugs per cylinder) (or other fuel ignition means) is positioned in the upper portion of cylinder walls 16. Alternatively, such spark plug(s) 12 can be positioned in head plate 14, e.g. about the center longitudinal axis of elongated firing chamber 17.

Also in the upper portion of cylinder walls 16 (or in head plate 14, as described above) is positioned fuel introduction means 11 (which can comprise fuel injectors for spark-ignited gasoline engines and diesel fuel injectors for compression ignited engines) for injection of liquid fuel throuqh an internal passage communicating the firing chamber 17 with a conventional fuel supply (not shown) external to the engine. More than one such injector may be employed per cylinder 16, e.g. from 1 to 6 such injectors per cylinder, to maximize the rate of fuel flow to the engine.

While fuel injector means 11 and spark plug means 12 are illustrated in FIG. 1 as substantially horizontally positioned, it will be understood that either or both can be angled to the horizontal, and when position in side walls 16 are preferably downwardly sloping into the chamber for ease of access to, and removal of, each for maintenance purposes. Preferably, both fuel injection means 11 and spark plug means 12 are located as close to the lower surface of head plate 14 as possible (without coming into contact with valve 7 during operation of the engine) to permit the maximum compression of the fuel/air mixture in chamber 17 and hence to derive greater engine-generated power from the combustion of the thus-compressed gases.

In their closed position, each valve 7 is firmly seated in a recessed portion of the inner wall of head plate 14 to prevent substantial passage of gases either from or into firing chamber 17.

At the upper end of crankcase housing 2, in accordance with the illustrated embodiment of my invention the walls of housing 2 are inwardly converging (e.g. inwardly sloping) to define upper converging gas space 30 within gas chamber 26 which gas spaces are positioned about lower cylinder wall portion 44. By "converging" gas space herein it is meant that the upper portion of walls 36 and the downwardly extending wall portion 44 which define gas space 30 (which is located annularly about the walls 44) are arranged so that the cross-sectional area of gas space 30 at the lowermost surface of channel 22 (taken along line A-A' in FIG. 1) is less (and preferably at least 5%, and more preferably at least 25% (e.g. from about 50 to 200% or more) less) than the cross-sectional area of gas space 30 at the lowermost level to which walls 44 extend into chamber 26 (taken along line B-B' in FIG. 1).

Each gas channel 22 directly communicates the uppermost part of converging gas space 30 with firing chamber 17, to permit rapid and efficient gas charging of chamber 17. Each such gas channel 22 is preferably substantially circular in cross-section (in the direction of gas flow therethrough) and at the point the gas inlet channels opens into the inner surfaces of cylinder walls 16 is preferably angularly disposed such that the center longitudinal axis of each channel 22 forms an angle "$\alpha$" with the vertical, inner wall of chamber 17, of from about 10 to 60 degrees, most preferably of from about 30 to 50 degrees. The combination of such converging gas space 30 and angularly disposed gas inlet channels 22 provides gas charging with rapid velocities and high efficiencies.

The length of firing chamber 17 is such that at the full upper stroke of piston 20 (not shown), piston 20 will not come into contact with any portion of cylinder head plate 14 or with spark plug 12, valve 7 or fuel introduction means 11. At its full lower stroke piston 20 uncovers each gas inlet channel 22 to permit gaseous communication between gas compression chamber 26 (via converging gas space 30) and firing chamber 17. In turn, lower portion 44 of the cylinder wall is of a length sufficient to preferably ensure that piston 20, at its lowest point, remains at least partially housed within the cylindrical extension of chamber 17 formed by the inner walls of cylinder portion 44 as described above.

In the usual two-stroke operation, air (which can be introduced to chamber 26 in the proper or desired ratio to the fuel by conventional air metering means) is drawn into gas compression chamber 26 by means of valve 4 when piston 20 moves in its upstroke after the closing of gas channels 22, thereby depressuring chamber 26 sufficiently to permit such fresh air to pass thereto from passage 45. In its downstroke, piston 20 pressurizes the air trapped in chamber 26 upon closing of valve 4. Upon reaching a lower point in its downstroke, the upper surface of piston 20 uncovers, and thus opens, gas channels 22 and permits the pressurized air to pass from converging gas space 30 through channels 22 into firing chamber 17, in which the pressure had been previously lowered as a result of the piston 20 downstroke and the opening of exhaust valves 7. Exhaust valves 7 are caused by action of cam means 8 to close after the fresh air is charged into chamber 17 and to permit the fresh air to be pressured in chamber 17 during the upstroke of piston 20. If desired, valves 7 can be permitted to remain open for a portion of the upward stroke of piston 20 to permit the lowermost gas layer (which comprises the fresh air) to assist in more completely forcing the exhaust gases from chamber 17. At the desired point in the upward travel of piston 20, fuel is injected into firing chamber 17 by fuel introduction means 11 and (if desired, after further compression) spark plug 12 is activated to explosively ignite the thus-pressured fuel/air mixture and to thereby force piston 20 downwardly, whereupon valves 7 are opened to allow the thus-formed exhaust gases to exit chamber 17. The timing and precise manner of operation of cam means 8, valves 7, fuel introduction means 11, spark plug 12 and piston 20 is fully conventional, and since such will be readily understood by one of ordinary skill in the art, further detailed description thereof will not be given herein.

Figures 4, 5, 6:
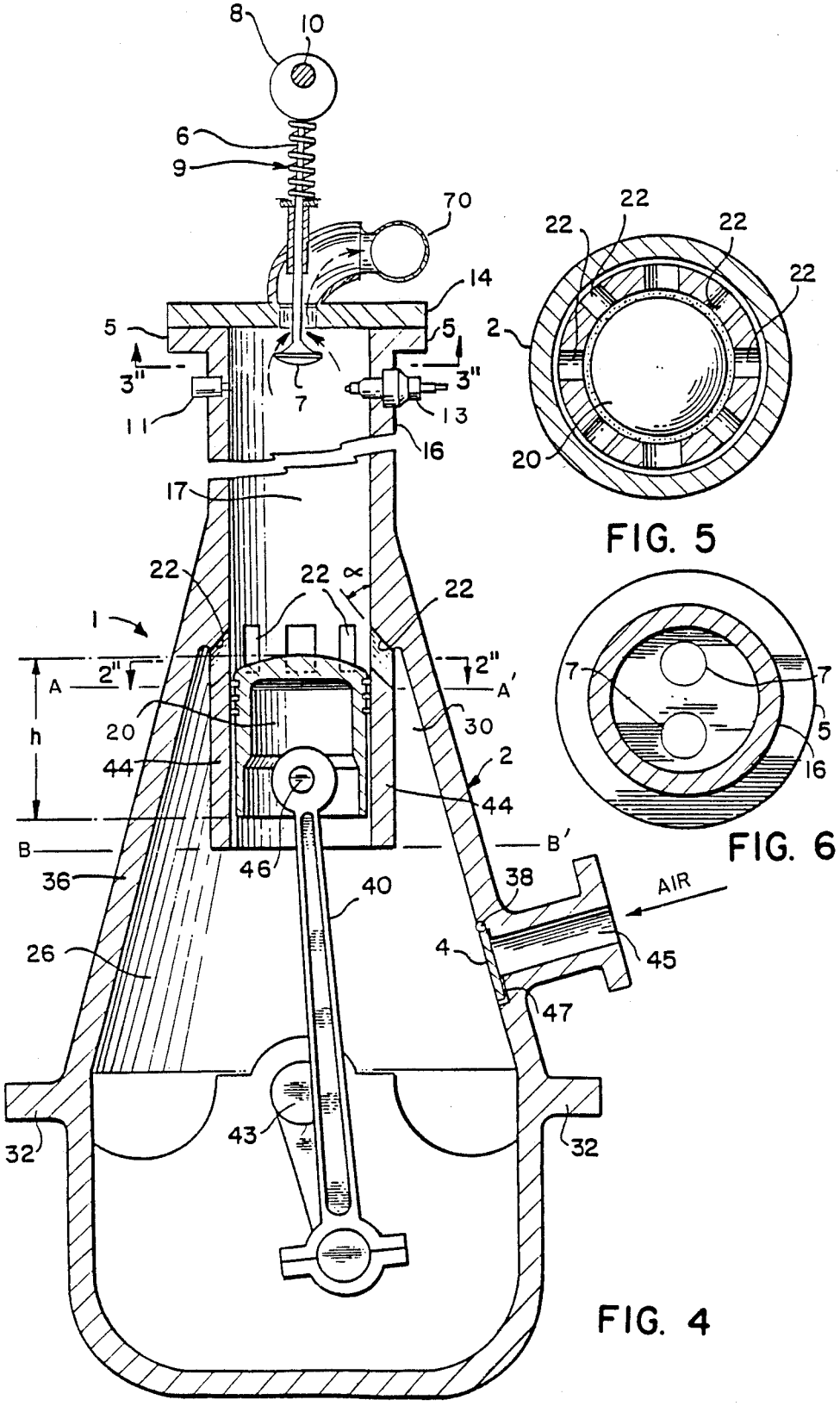
FIG. 4 is a vertical cross-sectional view of a second embodiment of a diesel, compression ignited internal combustion engine of this invention, with a single cylinder thereof being illustrated.
FIG. 5 is an enlarged horizontal cross-sectional view of the cylinder of FIG. 4 taken along line 2''—2'' in FIG. 1.
FIG. 6 is an enlarged horizontal cross-sectional view of the cylinder of FIG. 4 taken along line 3''—3'' in FIG. 1.

FIG. 4 illustrates a diesel engine in accordance with the present invention, wherein fuel introduction means 11 is adapted for introduction of liquid diesel fuel into firing chamber 17, and wherein one (or more) glow plug 13 is provided through the wall 16 to assist in cold starting (and cold-condition operation) of the engine. In the illustrated diesel engine, the fuel ignition means is provided by conventional high compression ratios in the firing chamber (e.g., employing compression ratios of from about 1:10 to 1:40, more usually from 1:15 to 1:30 and preferably from 1:18 to 1:25). The number of such diesel fuel injectors 11 and glow plugs 13, and the location and operation thereof, is as described above for the fuel injectors and spark plugs of the engine illustrated in FIGS. 1–3, as is the manner of arrangement, function and cooperative operation of the remaining engine components.

Figure 7:
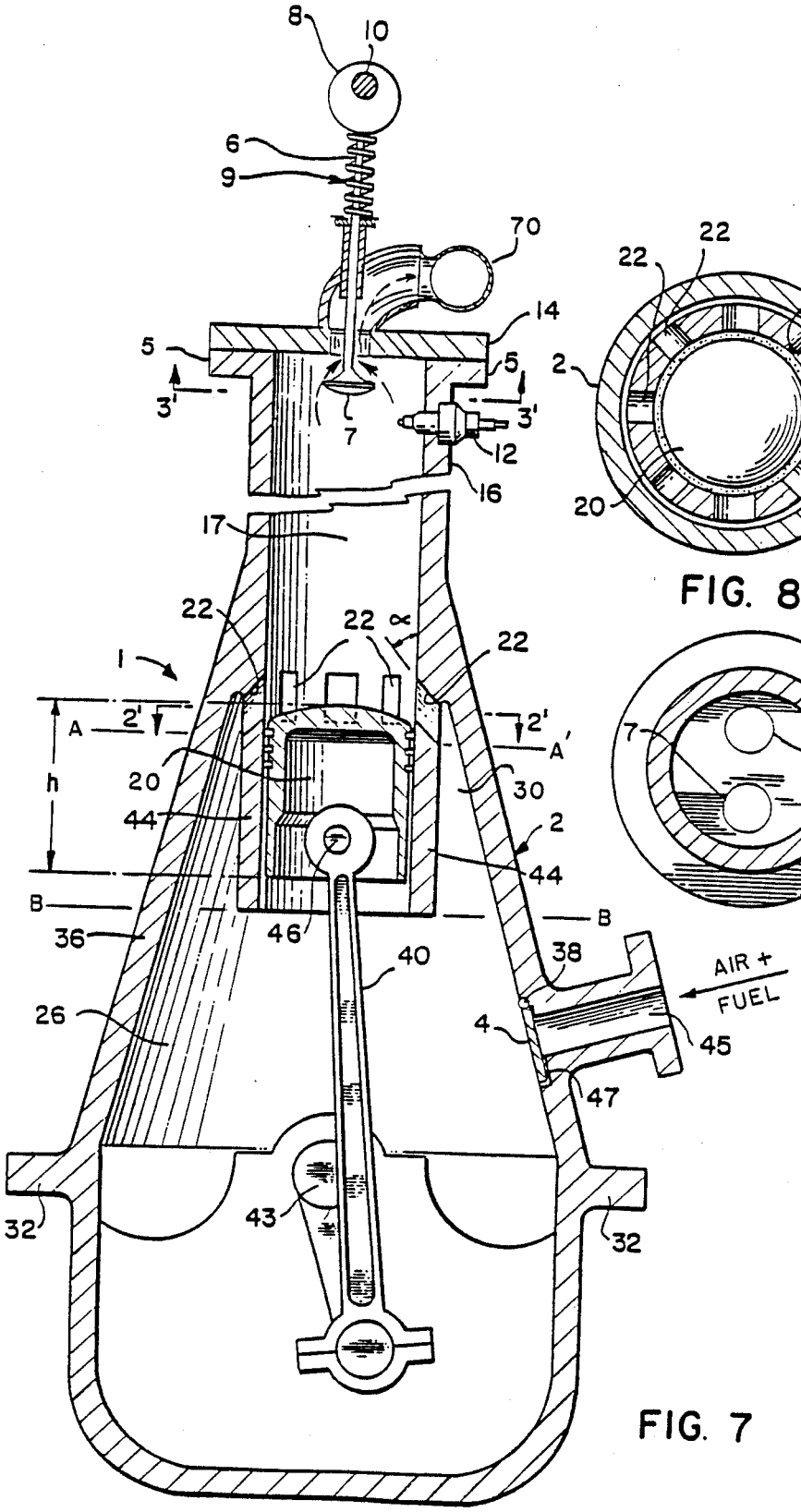
FIG. 7 is a vertical cross-sectional view of a third embodiment of a fuel-injected, spark ignited internal combustion engine of this invention, with a single cylinder thereof being illustrated.
Figure 8:
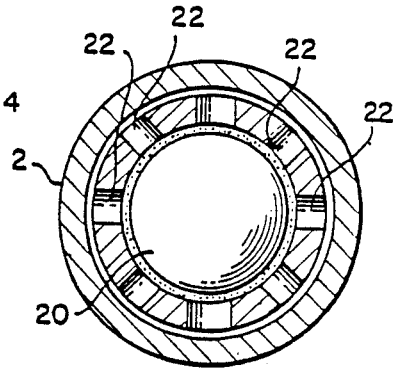
FIG. 8 is an enlarged horizontal cross-sectional view of the cylinder of FIG. 7 taken along line 2'—2' in FIG. 7.
Figure 9:
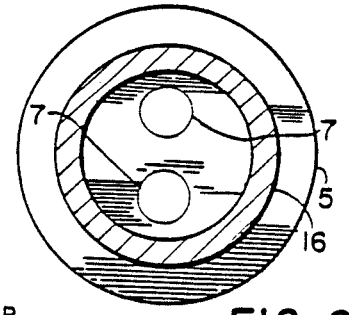
FIG. 9 is an enlarged horizontal cross-sectional view of the cylinder of FIG. 7 taken along line 3'—3' in FIG. 7.

FIG. 7 illustrates another embodiment of the engines of my invention wherein the fuel and air are introduced into the gas compression chamber 26 as fuel/air mixtures, for compression therein and for introduction of the resulting compressed fuel/air mixtures into firing chamber 17 via gas channels 22 as described above. In this embodiment, the use of fuel introduction means 11 is not required, although such fuel introduction means 11 for direct introduction of fuel into chamber 17 can be used in combination with the introduction of fuel into compression chamber 26 if desired. The manner of arrangement, function and cooperative operation of the remaining engine components is as described above for the first two above-discussed embodiments.

It is to be understood that the form of my invention herein shown and described is to be taken as a preferred example of the same and that various changes in the shape, size and arrangement of parts may be resorted to without departing from the spirit of my invention, or the scope of the claims hereinafter presented.

I claim:

1. An internal combustion engine cylinder assembly comprising a cylinder having substantially vertically disposed interior walls defining a firing chamber therein; piston means housed within said firing chamber and adapted for vertical reciprocation within said firing chamber; gas inlet channels in the lower portion of said firing chamber; a crankcase housing having a gas compression chamber disposed therein; valve means adapted for passing fresh air into the gas compression chamber upon the depressuring thereof; a cylinder closure means positioned at the upper end of said cylinder defining the upper end of said firing chamber and being provided with exhaust gas valve means, adapted for cyclic opening and closing to alternatively permit the removal of exhaust gases from said firing chamber and the pressuring of said fresh air in said firing chamber; fuel introduction means for introducing fuel into the upper portion of said firing chamber to form fuel/air mixtures therein; fuel ignition means for igniting a compressed fuel/air mixture in said firing chamber; at least a portion of said cylinder inner walls extending downwardly into said gas compression chamber and adapted to house at least a portion of said piston means therein during the full downstroke of said piston means; the upper portion of said crankcase housing having inwardly converging walls to define a converging gas space in the upper portion of said gas compression chamber annularly about said downwardly extending cylinder portion, said gas inlet channels providing gaseous communication between said firing chamber and said converging gas space, and said piston means being arranged to cyclically open and close said gas inlet channels to control said gaseous communication; said piston means cooperating with said exhaust valve means, said fuel introduction means and said fuel ignition means for controlling the pressurization and charging into said firing chamber of fresh air from said converging gas space, fuel from said fuel introduction means and the compression and ignition of said resulting fuel/air mixtures in said firing chamber to generate power and to remove from said firing chamber the thus generated exhaust gases.

2. The internal combustion engine cylinder assembly according to claim 1 wherein said downwardly extending portion of said cylinder walls have a length of from about 0.4 to 1.5 times the height of said piston means.

3. The internal combustion engine cylinder assembly according to claim 1 wherein said gas inlet channels in said lower portion of said firing chamber are spaced substantially evenly about the circumference of said firing chamber.

4. The internal combustion engine cylinder assembly according to claim 3 wherein a total of from about 6 to 10 of said gas inlet channels are provided about said lower circumference in said firing chamber.

5. The internal combustion engine cylinder assembly according to claim 1 wherein each said gas inlet channel is substantially circular in cross-section and is disposed such that its center longitudinal axis forms an angle of from about 10 to 60 degrees with said vertically disposed interior walls defining said firing chamber.

6. The internal combustion engine cylinder assembly according to claim 1 wherein said firing chamber is elongated.

7. The internal combustion engine cylinder assembly according to claim 6 wherein said valve means comprises at least one reed valve.

8. The internal combustion engine cylinder assembly according to claim 7 wherein said gas inlet channels in said lower portion of said firing chamber are spaced substantially evenly about the circumference of said firing chamber.

9. The internal combustion engine cylinder assembly according to claim 8 wherein a total of from about 6 to 10 of said gas inlet channels are provided about said lower circumference in said firing chamber.

10. The internal combustion engine cylinder assembly according to claim 9 wherein each said gas inlet channel is substantially circular in cross-section and is disposed such that its center longitudinal axis forms an angle of from about 10 to 60 degrees with said vertically disposed interior walls defining said firing chamber.

11. The internal combustion engine cylinder assembly according to claim 10 wherein said downwardly extending portion of said cylinder walls have a length of from about 0.4 to 1.5 times the height of said piston means.

12. An internal combustion engine cylinder assembly comprising an elongated cylinder having substantially vertically disposed interior walls defining an elongated firing chamber therein; piston means housed within said firing chamber and adapted for vertical reciprocation within said firing chamber; upwardly sloping gas inlet channel means in the lower portion of said firing chamber, the center longitudinal axis of each said gas inlet channel forming an angle of from about 10 to 60 degrees with said vertically disposed interior walls defining said elongated firing chamber; a crankcase housing having a gas compression chamber disposed therein; reed valve means pivotally secured to the inner walls of said gas compression chamber and adapted for passing air into the gas compression chamber upon the depressuring thereof; cylinder closure means positioned at the upper end of said cylinder defining the upper end of said firing chamber and being provided with exhaust gas valve means, adapted for cyclic opening and closing to alternatively permit the removal of exhaust gases from said firing chamber and the pressuring of said fresh air in said firing chamber; fuel introduction means for introducing fuel into the upper portion of said firing chamber; fuel ignition means for igniting a compressed fuel-/air mixture in said firing chamber; at least a portion of said elongated cylinder inner walls extending downwardly into said gas compression chamber and adapted to house at least a portion of said piston means therein during the full downstroke of said piston means; the upper portion of said crankcase housing having inwardly sloping walls to define a converging gas space in the upper portion of said gas compression chamber annularly about said downwardly extending cylinder portion, said gas inlet channels providing direct gaseous communication between said firing chamber and said converging gas space, and said piston means being arranged to cyclically open and close said gas inlet channels to control said gaseous communication; said piston means cooperating with said exhaust valve means, said fuel introduction means and said fuel ignition means for controlling the pressurization and charging into said firing chamber of fresh air from said converging gas space, and fuel from said fuel introduction means, and the compression and ignition of said resulting fuel/air mixtures in said firing chamber to generate power and to remove from said firing chamber the thus generated exhaust gases.

13. The internal combustion engine cylinder assembly according to claim 12 wherein a total of from about 2 to 20 of said gas inlet channels are provided in said firing chamber's lower portion.

14. The internal combustion engine cylinder assembly according to claim 13 wherein said gas inlet channels are spaced substantially evenly about said firing chamber's lower portion.

15. The internal combustion engine cylinder assembly according to claim 14 wherein said downwardly extending portion of said elongated cylinder walls have a length of from about 0.4 to 1.5 times the height of said piston means.

16. An internal combustion engine cylinder assembly comprising a cylinder having substantially vertically disposed interior walls defining a firing chamber therein; piston means housed within said firing chamber and adapted for vertical reciprocation within said firing chamber; gas inlet channels in the lower portion of said firing chamber; a crankcase housing having a gas compression chamber disposed therein; valve means adapted for passing fresh air/fuel mixtures into the gas compression chamber upon the depressuring thereof; a cylinder closure means positioned at the upper end of said cylinder defining the upper end of said firing chamber and being provided with exhaust gas valve means, adapted for cyclic opening and closing to alternatively permit the removal of exhaust gases from said firing chamber and the pressuring of said fresh air/fuel mixtures in said firing chamber; fuel ignition means for igniting a compressed fuel/air mixture in said firing chamber; at least a portion of said cylinder inner walls extending downwardly into said gas compression chamber and adapted to house at least a portion of said piston means therein during the full downstroke of said piston means; the upper portion of said crankcase housing having inwardly converging walls to define a converging gas space in the upper portion of said gas compression chamber annularly about said downwardly extending cylinder portion, said gas inlet channels providing gaseous communication between said firing chamber and said converging gas space, and said piston means being arranged to cyclically open and close said gas inlet channels to control said gaseous communication; said piston means cooperating with said exhaust valve means and said fuel ignition means for controlling the pressurization and charging into said firing chamber of fresh air/fuel mixtures from said converging gas space and the compression and ignition of said fuel/air mixtures in said firing chamber to generate power and to remove from said firing chamber the thus generated exhaust gases.

17. The internal combustion engine cylinder assembly according to claim 16 wherein said downwardly extending portion of said cylinder walls have a length of from about 0.4 to 1.5 times the height of said piston means.

18. The internal combustion engine cylinder assembly according to claim 17 wherein said gas inlet channels in said lower portion of said firing chamber are spaced substantially evenly about the circumference of said firing chamber.

19. The internal combustion engine cylinder assembly according to claim 18 wherein a total of from about 6 to 10 of said gas inlet channels are provided about said lower circumference in said firing chamber.

20. The internal combustion engine cylinder assembly according to claim 17 wherein each said gas inlet channel is substantially circular in cross-section and is disposed such that its center longitudinal axis forms an angle of from about 10 to 60 degrees with said vertically disposed interior walls defining said firing chamber.

* * * * *